United States Patent [19]

Cameron

[11] 4,443,909

[45] Apr. 24, 1984

[54] CARPET CLEANING SYSTEM

[76] Inventor: James D. Cameron, 1426 Cider Knoll Way, Westchester, Pa. 19380

[21] Appl. No.: 299,945

[22] Filed: Sep. 8, 1981

[51] Int. Cl.[3] ..... A47L 5/12

[52] U.S. Cl. ..... 15/320; 15/321; 165/51

[58] Field of Search ..... 15/320, 321; 280/5 R, 280/5 D; 165/51

[56] References Cited

U.S. PATENT DOCUMENTS

| | | | |
|---|---|---|---|
| 927,094 | 7/1909 | Beaupain | 280/5 R |
| 2,862,631 | 12/1958 | Gamble | 280/5 R X |
| 4,284,127 | 8/1981 | Collier et al. | 15/321 X |
| 4,336,627 | 6/1982 | Bascus | 15/321 |

*Primary Examiner*—Chris K. Moore

*Attorney, Agent, or Firm*—Anthony J. McNulty

[57] ABSTRACT

An apparatus for cleaning a carpet which includes two reservoirs mounted on a frame over the rear wheels of a truck to store a supply of cleaning fluid which is heated in a heat exchanger is disclosed. The reservoirs reduce the sloshing of fluid when the truck is in motion. Pivot flanges are used to balance the reservoirs on the frame to provide effective transfer of the apparatus from one truck to another. The truck engine generates heat energy which is convectively transferred to the engine coolant fluid which is subsequently cycled through the heat exchanger. The cleaning fluid is also transported to the heat exchanger where heat transfer takes place between the cycling engine coolant fluid and the cleaning fluid. The cleaning fluid is heated to a higher temperature condition prior to being sprayed on and into the rug while the engine coolant fluid is cooled prior to being recycled through the engine. A vacuum, enhanced by the flexing movement of the walls of a dirt container or soil tank, provides for suctioning of dirt from the carpet.

10 Claims, 5 Drawing Figures

CARPET CLEANING SYSTEM

BACKGROUND OF THE INVENTION

1. Field of the Invention

This invention relates to a truck-mounted carpet cleaning unit.

2. Description of the Prior Art

Many machines have been developed for cleaning carpets which are normally brought to the work site in a truck or van. Usually the main power plant for the unit is mounted in the truck and the only equipment brought into the building at the work site is a vacuum wand and hoses. The hoses are connected between the nozzle of the wand and the machinery in the truck and, typically, one hose is used for transporting the cleaning fluid while another hose is used for drawing a vacuum in order to pull dirt and used cleaning fluid from the carpet.

Usually the equipment mounted in the truck includes cleaning fluid supply tanks, an electric heater for heating the cleaning fluid, a pump for moving the fluid to the wand, a vacuum pump for withdrawing the fluid from the wand, and a vacuum box for temporarily storing the dirt and cleaning fluid drawn out of the carpet.

Specifically, prior art truck-mounted cleaning units have included multiple cleaning fluid tanks mounted on portable frames and at least one hose and hose reel as disclosed in U.S. Pat. No. 4,154,578, issued May 15, 1978 to Bane. Other cleaning units, such as the invention described in U.S. Pat. No. 4,158,248, issued June 19, 1979 to Palmer, have chemical storage and supply tanks mounted on one side of the truck.

Also, U.S. Pat. No. 4,109,340, issued Aug. 29, 1978 to Bates, discloses a truck-mounted cleaning apparatus in which the cleaning fluid is used as the engine coolant and the engine operates as a heat exchanger, heating the cleaning fluid prior to being sprayed on the rug.

Other U.S. Pat. Nos. 2,555,822, issued June 5, 1951 to Smith, and 3,341,081, issued Sept. 12, 1967 to King, describe the heating of a fluid by the heat generated from an internal combustion engine.

In other prior art cleaning units, in order to provide power to the heater as well as to the pumps, it is usually necessary for the operator to connect his equipment to the electrical system of the building in which the carpet is being cleaned. Under certain conditions it is necessary for the operator to connect his equipment in a number of separate electrical outlets involving more than one circuit to avoid overloading the circuitry in the building.

SUMMARY OF THE INVENTION

A mobile carpet cleaning apparatus is mounted on a four wheel vehicular structure having a fluid cooled engine. The coolant, heated during the time that the engine is running, is passed through a portion of the heat exchanger system through which is also provided a relatively cooler cleaning fluid. The engine coolant and cleaning fluid are separated from each other within the heat exchanger since tubes, which transport the cleaning fluid, are positioned within a conduit that provides for the coolant to flow about the tubes. In this manner, heat exchange occurs between the flowing coolant and the moving cleaning fluid such that the cleaning fluid will become heated by the coolant which becomes cooled prior to returning to the engine block. The heated cleaning fluid is then provided to the vacuum wand for more efficient cleaning, in a conventional manner, of carpets and other fabrics.

The apparatus also has a plurality of cleaning fluid filled tanks, each mounted over a rear wheel of the vehicle on a framework that can pivot and slowly collapse, i.e., as a result of an impact upon collision, in such a way that the tanks can pitch forward or rearward minimizing damage to the apparatus and providing safety to the people in the vehicle.

An object of this invention is to balance separate fluid filled tanks over different wheels of the vehicle in order to reduce the effect that the fluid sloshing movement would have on the over-the-road handling of the vehicle.

An additional object of this invention is to provide for the framework to pivot and slowly collapse during collision of the vehicle thereby minimizing damage to the apparatus and providing safety to the vehicle's occupants.

A further object of this invention is to balance the fluid filled tanks or pivot flanges to facilitate transfer of the cleaning apparatus from one vehicle to another.

Another object of this invention is to provide an additional vacuum reserve produced by the flex movement of the walls of a dirt vacuum box or soil tank so as to enhance the suction in the cleaning wand.

DETAILED DESCRIPTION OF THE PREFERRED EMBODIMENT

Figure 1:
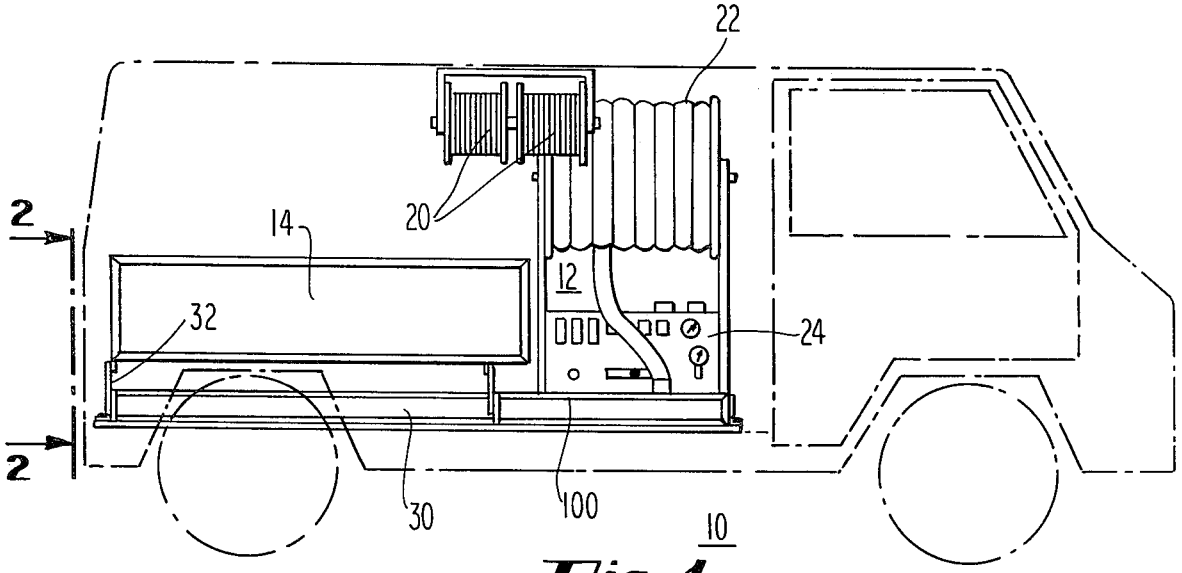
FIG. 1 is a side view of the truck containing the multiple carpet cleaning unit in the back.
Figure 3:
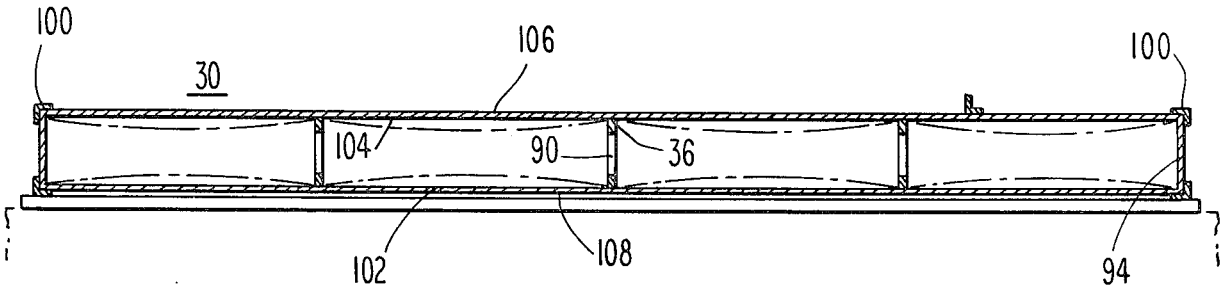
FIG. 3 is a partial side view of the framework of FIG. 2 taken along 3—3 showing the frame grommets and vacuum box.
Figure 4:
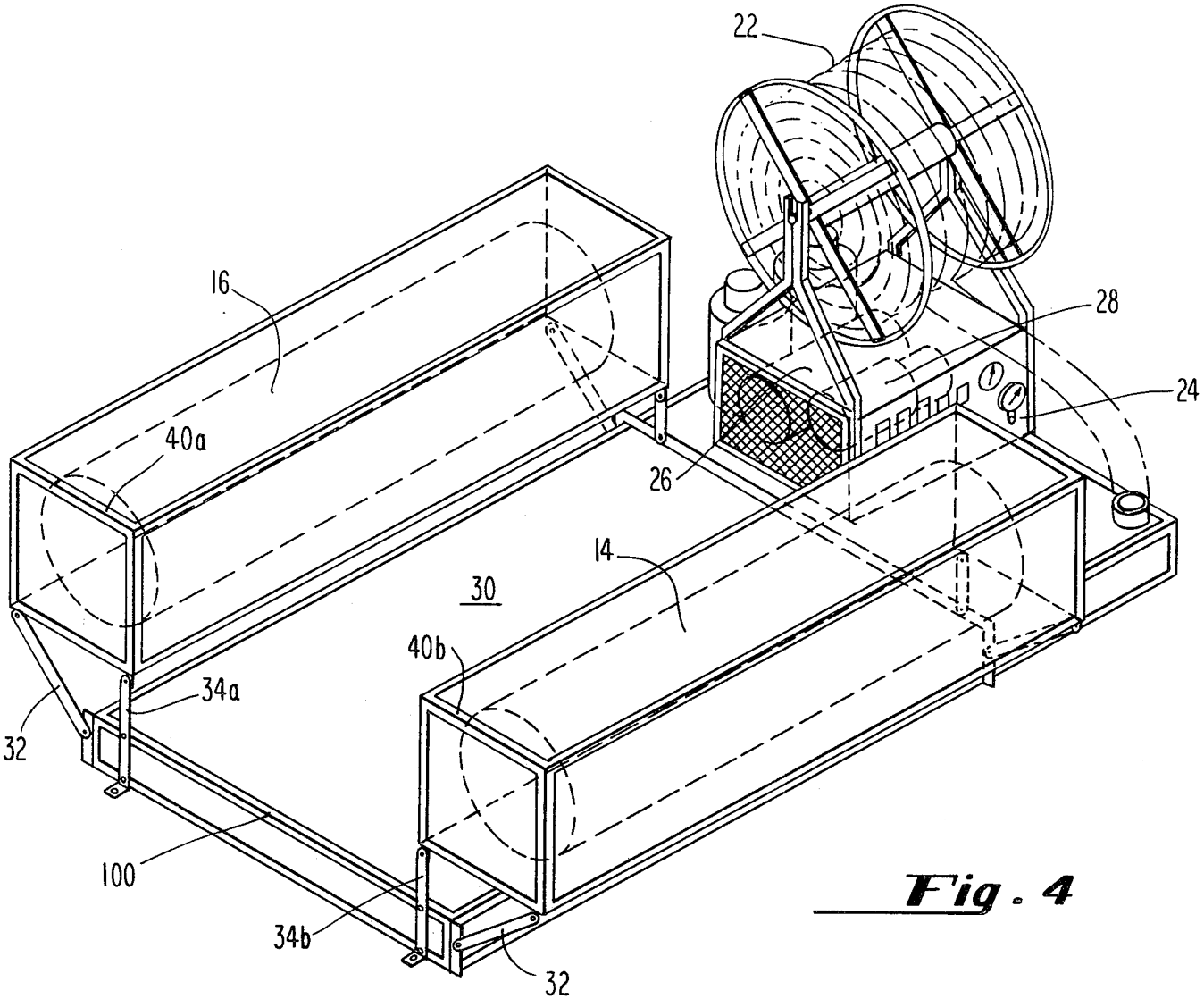
FIG. 4 is a perspective view of the mobile carpet cleaning unit of FIG. 1 emphasizing its overall framework.

Referring to FIG. 1 and FIG. 4, a cleaning vehicle such as a van or truck 10 contains the mobile carpet cleaning unit 12 which has component machinery including framework 100, braces 32, appertured support partitions or frame grommets 36, pivot flanges **34*a* and 34*b*, two cleaning supply tanks 14 and 16, hoses 20 and 22, console 24 for heat exchanger 26, temperature control tank 28 and blowers 44*a* and 44*b*. FIG. 3 more clearly shows partitions or frame grommets 36 enclosed in a vacuum box 30 that receives the dirt and residue from the carpet cleaning operation. Frame grommets 36** have apertures or openings to allow communication between subcompartments formed within said vacuum box.

Specifically, vacuum box 30 is formed of flexible, flat metal sheets and shaped as a substantially rectangular, watertight compartment. The depth, length and width dimensions are constrained by the size of the vehicle used to transport unit 12. A plurality of grommets 36 are used as supports to keep the opposite sides of box 30 substantially parallel to each other. The grommets or partitions are rectangular in shape having a width slightly smaller than the depth of box 30 and a length slightly smaller than the width of box 30. The grommets are positioned substantially equidistant from ends 92 and 94 of box 30 and from each other, and provide rigid support for the sides of the box.

The grommets extend lengthwise across the width of box 30 and are substantially fastened perpendicularly to the interior sides 104 and 102 of top metal sheet 106 and bottom metal sheet 108, respectively. Grommets 36 have openings 90 to allow for communication between the subcompartments that are formed once the grommets are positioned and the box is formed.

The flexible metal sheets are soldered perpendicularly at their edges enclosing the support partitions or grommets to form a watertight, box-like structure. The watertight box or vacuum box 30 is held in position in the vehicle by framework 100.

Figure 2:
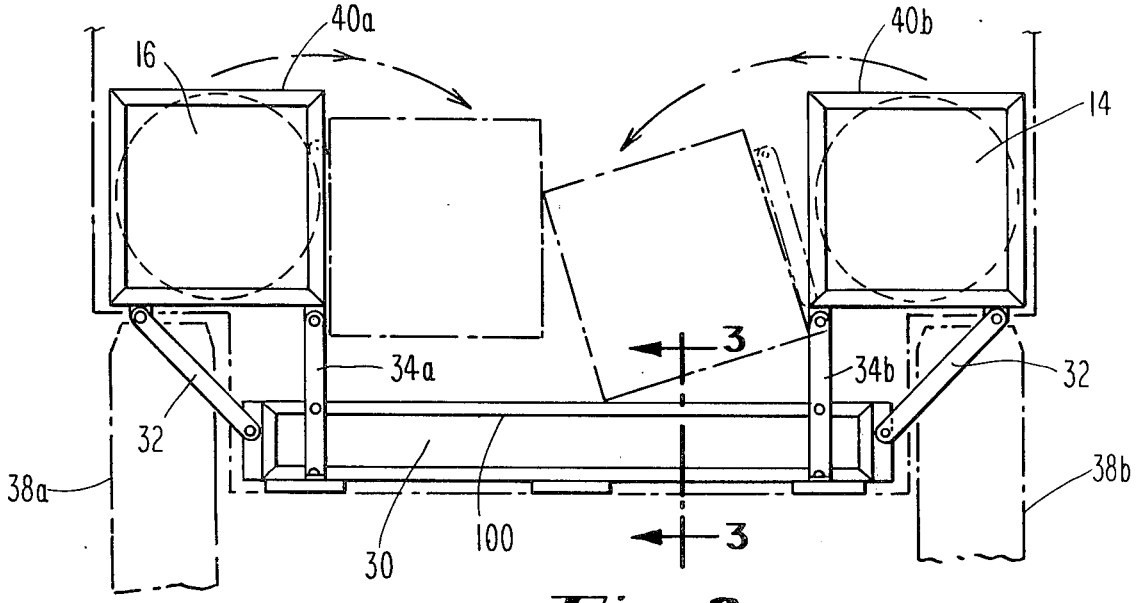
FIG. 2 is a partial rear view of the truck of FIG. 1 taken along 2—2 showing the framework and alternative tank positions.

As is shown in FIG. 2, supply tanks 14 and 16 are securely positioned within frames 40*a* and 40*b* which are securely bolted to braces 32 and pivotally mounted on pivot flanges 34*a* and 34*b*. The braces and flanges are bolted to framework 100 which is integrally connected to and removably mounted on the truck chassis. The combination of frames 40*a*, 40*b*, braces 32, pivot flanges 34*a*, 34*b*, and framework 100 substantially form the overall framework of unit 12. The tanks and tank support frames may be made to pivot, on said pivot flanges, into position over framework 100 (as shown in phantom) so that the entire cleaning unit may be moved through the rear-door of truck 10 during transfer of the machinery from one van or truck to another. However, before rotating the tanks to a position over framework 100 from a position above the rear wheels of the vehicle, the braces 32 would have to be disconnected at the point where they are fastened to the framework. Once the unit is in place in the truck, the tanks and tank support frames may be positioned over each of the rear wheels 38*a* and 38*b* by rotation of the tanks in the opposite direction on pivot flanges 34*a* and 34*b* and by reconnection of braces 32. Thus, it can be seen how the pivot flanges complement the transfer of unit 12 components from one van or truck to another.

Pivot flanges 34*a* and 34*b* also aid in balancing the weight of supply tanks 14 and 16 by positioning the tanks inside of the truck as far as possible from the truck's center of gravity, i.e., over the rear wheels 38*a* and 38*b*. Balancing the load in this manner provides for safe over-the-road handling of the vehicle 10 so as to reduce the driving hazard created by the sloshing movement of the water in the tanks 14 and 16 while the vehicle is in motion. Furthermore, the frames 40*a* and 40*b*, with tanks 14 and 16, can pitch forward or rearward and collapse slowly in the vehicle on pivot flanges 34*a* and 34*b*, respectively immediately after impact due to a head on or rear end collison of the vehicle 10 during over-the-road transport of unit 12. The pitching movement of the frames and tanks after impact of the vehicle provides for the safety of the people in the vehicle and minimizes the damage to the components of unit 12.

Console 24, hoses and reels 20 and 22, are also removably connected to the framework 100. However, at no time are the tanks, console, hoses and reels required to be removed from frames 100, 40*a*, and 40*b*, nor are braces 32 and flanges 34 unfastened from said frames in preparation for cleaning. Nevertheless, the modularly mounted and secured components of said carpet cleaning unit can be easily replaced whenever desired, for example, when transferring the unit or portions thereof from one truck to another.

Figure 5:
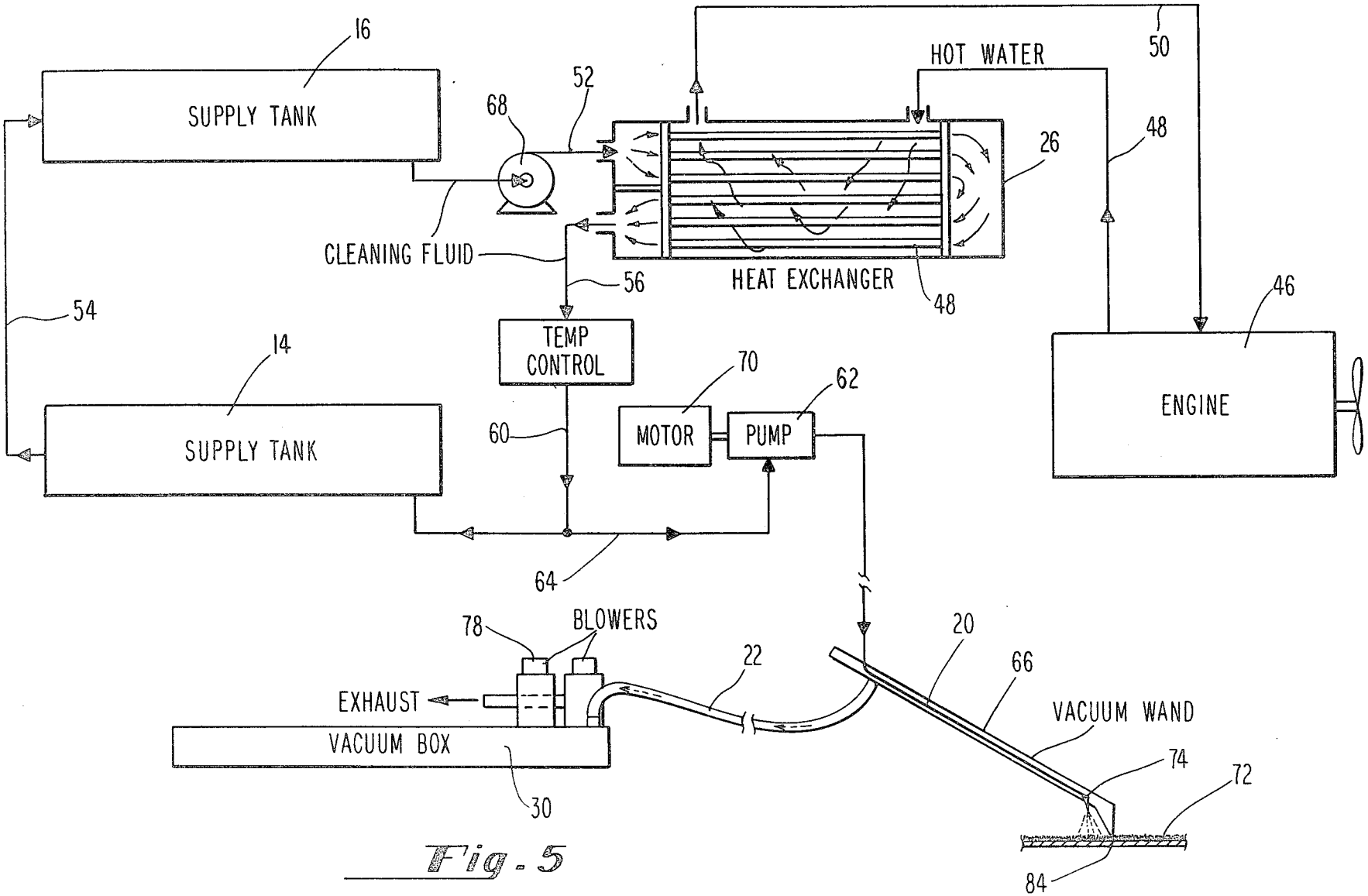
FIG. 5 is a system block diagram of the mobile carpet cleaning unit of FIG. 1.

An internal combustion engine 46 requires lubricating oil to remove heat from the engine block and uses a fluid coolant such as water to cool the oil. In the preferred embodiment, which is shown in FIG. 5, the engine coolant is provided as input, along passageway 48, to heat exchanger 26. The coolant is at a relatively high temperature when it enters said heat exchanger after having removed heat from the engine as it circulated through the block.

The hot coolant, when it enters the heat exchanger chamber, circulates about a plurality of tubes 48 within which passes a relatively cooler cleaning fluid. The coolant does not directly mix with the cleaning fluid. Heat transfer occurs by convection through the tubes between the hotter coolant and the cooler cleaning fluid. As a result, the cleaning fluid becomes warmer during the time it passes through said tubes and the coolant become cooler as it circulates about said tubes prior to flowing back to engine block 46 along passageway 50. The coolant is kept cycling in a closed system during the rug cleaning operation and is continuously circulated, first, to cool down the engine block by removing heat generated by engine 46 during a portion of its cycle and, second, to heat up the cleaning fluid by transferring its heat content in the other portion of its cycle.

On the other hand, cleaning fluid, made to flow from tank 14 along line 54 to tank 16, is pumped via passageway 52 through tubes 48 in heat exchanger and becomes hot. The hot cleaning fluid then exits said heat exchanger along line 56, through temperature controller 58 and along passageway 60. The cleaning fluid either flows back to tank 14 or to pump 62 along line 64 depending upon whether vacuum wand 66 is in use at the time. That is, if said wand is not in use, the cleaning fluid will circulate through said tanks again. If said wand is in use, pump 62, driven by motor 70, will draw the cleaning fluid along hose 20 to wand 66 for cleaning rug 72.

Temperature controller 58 controls the cleaning fluid temperature so that it will not become too hot when used to clean the rug.

Specifically, when operator actuates said wand, hot cleaning fluid will be delivered through nozzle head 74 from pump 62 via hose 20. The cleaning fluid is heated by the coolant from engine 46 for the purpose of providing more efficient and effective cleaning of carpets and upholstery. During the course of a carpet cleaning operation, there will be periods of time during which wand 66 will not be actuated by the operator. The hot cleaning fluid will then be recirculated to tanks 14 and 16 and not be permitted to flow through to hose 20.

The method of using carpet cleaning unit 12 begins when the operator starts engine 46 thereby allowing the engine coolant to heat up in the usual manner while circulating around said engine block for the purpose of removing the heat generated during engine operation. During this time, the coolant will also be drawn from the engine block to heat exchanger 26 in a closed loop that allows the coolant to continuously cycle between said engine block and a portion of said heat exchanger. Also at the same time, cleaning fluid is pumped by pump 68 to the other portion of said heat exchanger for the purpose of becoming heated due to heat transfer from the relatively hotter engine coolant. While the cleaning fluid is becoming heated, the operator can connect hoses 20 and 22 to the components of unit 12 and to vacuum wands 66. When a predetermined cleaning fluid temperature is achieved, as may be determined by a suitable temperature gauge on console 24, and is controlled by temperature controller 58, the operator may begin to clean the carpet. The operator would actuate nozzle head 74 on wand 66 for the purpose of injecting cleaning fluid into the carpet or rug 72 via hose 20 and to withdraw cleaning fluid and dirt from the carpet via hose 22. Fluid and dirt are withdrawn through narrow slot 84 into hose 22 and deposited temporarily in vacuum box 30 because of air compressors or blowers 78 which create a vacuum in said box to which the fluid and dirt move through return hose 22.

Vacuum box 30, shown in FIG. 3, adds to the effective cleaning of carpets and upholstery by providing a reserve vacuum load during unit 12 operation. The reserve vacuum load is provided by blocking off slot 84, by holding or forcing it against the carpet 72 during the cleaning operation, for a short period of time so as to decrease the pressure inside box 30 thereby forcing the flexible flat surfaces of the box inwardly. As the exertion of force on wand 66 is released, the flat surfaces of the vacuum box 42 move outwardly thereby adding more suction to that created by compressors or blowers 78 so as to provide for a greater suctioning of dirt from, for example, heavily soiled areas of the carpet. The inward-outward flexing movement of the surfaces of box 30 augments the vacuum produced by compressors 78 in wand 66 so as to provide for greater suctioning of dirt that would otherwise be difficult to suction using only the vacuum created by the compressors.

What is claimed is:

1. A mobile carpet cleaning apparatus including means for suctioning dirt and heated cleaning fluid from carpets and having frames attached to cleaning fluid-filled tanks in the chassis of a vehicle comprising:

a framework having a top and a bottom integrally connected to and removably mounted on said chassis;

pivot flanges vertically extending from the top of and rigidly secured at one end to the side of said framework and rotatively attached at the other end to said frames for providing rotation of said tanks in said frame about said flanges; and braces angularly extending from and removably secured at one end to the side of said framework and at the other end to said frames for prohibiting rotation of said tanks from a position over the rear wheels of said vehicle to a position over said framework until said braces are disconnected from said framework.

2. The mobile cleaning apparatus of claim 1 in which said pivot flanges allow for balancing the weight of said tanks in said vehicle by positioning said tanks over said rear wheels.

3. The mobile cleaning apparatus of claim 1 in which said pivot flanges allow for transfer of the apparatus from one vehicle chassis to another vehicle chassis by positioning said tanks over said framework.

4. The mobile cleaning apparatus of claim 1 wherein said pivot flanges allow for pivoting of said frames and also allow for pitching of said tanks toward the front or back of said vehicle on impact due to a collision.

5. The mobile cleaning apparatus of claim 1 wherein said means for suctioning dirt and heated cleaning fluid comprises:

compressor means mounted on said framework for providing a vacuum;

hose means through which dirt and heated cleaning fluid is suctioned from a carpet by the vacuum produced by said compressor means; and a box held in position by said framework having sides including two end sides of flexible metal sheets connected to said compressor means and to one end of said hose means to provide for elastic inward and outward movement of said sides as a consequence of said vacuum by holding or forcing against the carpet, and then releasing, the opposite end of said hose means thereby producing in said box a vacuum in addition to that produced by said compressor means to increase the suction of dirt and heated cleaning fluid through the opposite end of said hose means.

6. The apparatus of claim 5 wherein the opposite sides of said box are supported substantially parallel to each other by a plurality of apertured support partitions positioned and fastened across the width and depth of said box.

7. The apparatus of claim 6 wherein said appertured support partitions are positioned substantially equidistant from and parallel to each end side and each other forming subcompartments within said box.

8. The apparatus of claim 7 wherein said appertured support partitions have openings to provide for communication among said subcompartments.

9. The apparatus of claim 5 wherein said vehicle includes an engine block with a coolant circulating therethrough, said apparatus further comprising:

heat exchanger means for heating cleaning fluid mounted on said framework having a plurality of tubes and a chamber surrounding said tubes through which hot coolant is circulated from said engine block; and circulating means for pumping cleaning fluid from said tanks through said tubes, said heat exchanger means thereby providing for convective heating of said cleaning fluid.

10. The mobile cleaning apparatus of claim 1 wherein said vehicle includes an engine block with a coolant circulating therethrough, said apparatus also comprising:

heat exchanger means for heating cleaning fluid mounted on said framework having a plurality of tubes and a chamber surrounding said tubes through which hot coolant is circulated from said engine block; and circulating means for pumping cleaning fluid from said tanks through said tubes, said heat exchanger means thereby providing for convective heating of said cleaning fluid.

* * * * *